US007497487B2

(12) United States Patent
Burmahln

(10) Patent No.: US 7,497,487 B2
(45) Date of Patent: Mar. 3, 2009

(54) SNAP-IN LATCH HOUSING ASSEMBLY

(75) Inventor: Jedediah A. Burmahln, Yorba Linda, CA (US)

(73) Assignee: Southco, Inc., Concordville, PA (US)

( * ) Notice: Subject to any disclaimer, the term of this patent is extended or adjusted under 35 U.S.C. 154(b) by 558 days.

(21) Appl. No.: 11/065,691

(22) Filed: Feb. 24, 2005
(Under 37 CFR 1.47)

(65) Prior Publication Data

US 2005/0202705 A1 Sep. 15, 2005

Related U.S. Application Data

(60) Provisional application No. 60/547,108, filed on Feb. 24, 2004.

(51) Int. Cl.
*E05C 3/06* (2006.01)

(52) U.S. Cl. ..... 292/200; 292/DIG. 54; 292/DIG. 31; 292/DIG. 53; 292/DIG. 64; 292/337; 403/329

(58) Field of Classification Search ..... 292/200, 292/DIG. 54, DIG. 53, DIG. 31, 1, DIG. 64, 292/175; 403/326, 329, DIG. 11
See application file for complete search history.

(56) References Cited

U.S. PATENT DOCUMENTS 618,895 A * 2/1899 Munday et al. ..... 292/19
4,618,118 A 10/1986 Nardella et al.
4,681,389 A * 7/1987 Nakazawa et al. ..... 439/557
5,279,509 A 1/1994 Gifford
5,282,657 A * 2/1994 Clinch et al. ..... 292/336.3
5,575,163 A 11/1996 Kohl et al.
5,718,549 A * 2/1998 Noda et al. ..... 411/553
5,895,289 A * 4/1999 Smith ..... 439/553
6,082,788 A 7/2000 Turner et al.
6,280,206 B1 8/2001 Kuroda et al.
6,638,105 B1 * 10/2003 Wu ..... 439/567
7,104,575 B2 * 9/2006 Kakita ..... 292/348
2001/0054222 A1 * 12/2001 Spurr ..... 29/505

FOREIGN PATENT DOCUMENTS

DE 31 47 854 A1 9/1982
DE 3147854 A1 9/1982
DE 699 13 073 T2 8/2004
EP 0 989 648 B1 11/2003
FR 2588716 A1 * 4/1987
GB 2 264 595 A 9/1993

OTHER PUBLICATIONS

Combined search and examination report issued by UK Patent Office on application No. GB0503766.8.
English translation of abstract for DE3147854 A1.
English translation of DE3147854 A1.

* cited by examiner

*Primary Examiner*—Patricia Engle
*Assistant Examiner*—Mark Williams
(74) *Attorney, Agent, or Firm*—Paul & Paul

(57) ABSTRACT

A latch housing assembly has a latch housing and a retainer, wherein the housing includes a wall, and wherein a receiving aperture opens through the wall. The retainer includes a wall from which an insert protrudes. The insert, when disposed within the receiving aperture interlocks therewith.

18 Claims, 14 Drawing Sheets

SNAP-IN LATCH HOUSING ASSEMBLY

RELATED APPLICATIONS

This application claims priority of U.S. Provisional Application 60/547,108, filed Feb. 24, 2004, for a Snap-In Latch Housing Assembly, the disclosure of which is incorporated herein by reference.

FIELD OF INVENTION

The present invention pertains to a latch housing assembly. Particularly, it relates to latches with latch housings for mounting to panels and the like with quick-mount snap-in features.

BACKGROUND

Some latch assemblies are secured to various members such as cabinet doors, drawer panels, and other closures by way of housings. The members have bores into which housings are disposed. The housings are coupled to the members. The latch assemblies are disposed within the housings.

Particularly, latches can be used to secure panels, covers, doors, drawers, electronic modules, glove boxes, and the like to other generally larger structures, such as compartments, doorframes, panel fronts, frames, racks and other structures. These latches are mounted by various means, including screws, rivets, blade fasteners, spring clips, stake fasteners and other structures. Each latch generally includes a housing portion; and includes another portion, such as a lever, pull, button, stud, catch plate or other such structural member. The housing portion performs the function of the non-moving member, while the other portion performs the function of the moving member. Each latch is mounted so that the housing portion is fixed to the generally larger structure, i.e., the doorframe, panel front, frame, rack, and other structure.

At times, the ability to install a latch assembly, i.e., a latch housing without tools or with unsophisticated tools becomes important. Moreover, it becomes desirable that the latch housing has a flush outer appearance or is nearly flush and the latch assembly is nearly flush with the panel face when the latch is closed.

In these circumstances, the latch housing is mounted into a mating opening in the panel or door and can include a snap-in holding structure which holds the housing in place with respect to the panel or door.

There have been various designs for latches and connectors, which either include spring biasing or deformable members for quick mounting. Other latches, such as those for suitcases and the like have had a button activation with spring biasing. Further, others have incorporated a spring and cam operated ejection. One reference, Nardella, et al., U.S. Pat. No. 4,618,118, show a molded latch housing with a flanged surface installed in a rectangular cutout. A spring connected to the hook at the forward end of the latch keeps the latch normally in the locked position. Another reference, Kameyama, U.S. Pat. No. 5,279,509, shows a cable connector with deformable side stakes which act as a quick engagement mount. Once in the mounted position, the stakes return to their original position to lock the mounting. A further reference, Kohl et al., U.S. Pat. No. 5,575,163, show a removable attachment structure for a car radio, including a deformable spring lock member. An additional reference, Kuroda et al., U.S. Pat. No. 6,280,206, show a high voltage cable connector with deformable socket contacts which act as a locking mechanism once the two members of the connector are joined. Turner, et al,. U.S. Pat. No. 6,082,788, show a push-to-close latch where a cylindrical latch stud is pushed into a cylindrical receptacle having a plurality of longitudinal cuts therein to allow for a friction expansion fit with the stud.

These deformable features in the prior art have functioned as retaining members. In each instance they extend beyond the housing to engage the back face of the panel or door to hold the housing fast thereto. However, their shape and structure often lends them to becoming bent or broken, either through rough handling while in inventory or during installation. This requires that they be made of durable materials, such as spring steel, or reinforced polymer materials.

It is desirable to provide a latch with a flush or nearly flush face, which has a housing with a peripheral flange.

It is further desirable to provide a retainer for the housing which will hold the housing fast to the panel or door.

It is further desirable that the housing and retainer mate in a snap-together fashion, i.e., with a snap-in operation.

It is even further desirable that the snap-together mating structures of the housing and the retainer have a design which renders them durable and not easily bent or broken, but which permits them to be made of less expensive materials.

SUMMARY

The latch housing assembly of the present invention includes a latch housing and a mating retainer. The latch housing has a sidewall extending upwardly from a bottom wall. A retainer receiving aperture opens through the bottom wall and between an upwardly protruding ratchet. The ratchet can be two resilient members protruding away from the bottom wall. An open end, at one end of the sidewall, opposite the bottom wall, has an outwardly extending ledge.

The retainer member has a bottom wall and a sidewall extending therefrom. An insert extends from the bottom wall upwardly and between the sidewall. The sidewall provides an abutment surface spaced vertically from the bottom wall.

The latch housing assembly can have a clamped position. In the clamped position, the latch housing is disposed within a bore in a member. The retainer insert is disposed within the receiving aperture. The ratchet is interlocked with the insert. The ledge of the latch housing abuts up against a first surface of the member. The retainer abutment surface presses against a second surface of the member. The first and second member surfaces are oppositely oriented and on opposite sides of the member. The member is clamped between the retainer and the latch housing.

In particular, the retainer can be a U-shaped bracket with reinforcing ribs on its sidewalls. One or more, and preferably two, upstanding rectangular ribs or posts extend from the base wall into the U-shaped area. When two upstanding ribs are used, each extends parallel to one another and has a plurality of ratchet type teeth on one face or side thereof, preferably facing in opposing directions. The teeth are angled to provide one-directional gripping which permits the posts to be inserted into the housing and not removed. The tightness of the engagement is determined by the depth of insertion of the toothed posts.

The housing can be rectangular with an open top and a peripheral flange extending thereabout. A respective receiving opening is positioned in the bottom of the housing for receiving each toothed post. Each opening has associated with it a ratchet member carrying on it a tooth. Each housing ratchet tooth engages the one-way teeth of a respective retainer post.

A receiving wall structure can extend within the housing about where each toothed post extends. This receiving wall structure assures that the operating members of the latch assembly do not contact a toothed retainer post and thereby loosen or dislodge it.

A housing is assembled onto a panel by being inserted into a mating opening in the panel until the flange seats on the panel outside face. The retainer is then pushed onto the bottom of the housing extending through the panel until the toothed retainer posts engage their respective ratchet tooth and then the retainer is tightened into place with the sidewalls of the U-shape abutting the inside face of the panel.

As an alternative, the toothed retainer posts can be positioned further apart to extend outside the housing adjacent to two opposing walls of the housing. Those respective walls would then each have an outboard ratchet tooth, which would interact with a respective toothed retainer post. This alternative would require the reinforced sidewalls of the U-shaped retainer to considerably longer than the toothed retainer posts. Moreover, the "footprint" of the retainer as it abuts the inside face of the panel would be wider than where the retainer posts extended through the bottom of the housing. However, the internal up-standing wills which protect the retainer posts could be eliminated. Moreover, the choices for the latch mechanism would be greater, as there would be no obstructions inside of the housing.

Further alternatives are equally within the present invention. These include placing the ratchet teeth, i.e., the ratchet "track" on the inside side, opposed sidewalls of the U-shaped retainer bracket and the ratchet tooth on each housing wall adjacent to the ratchet "track". This would require a close fit of the retainer to the housing.

It is to be remembered that the ratchet "track" teeth are angled to permit only one-way interaction with the engaging-ratchet tooth. Moreover, the arrangement where the one-way ratcheting occurs exterior to the latch housing could be reversed. That is, the ratchet track could be placed on the outside face of the housing sidewalls and the ratchet tooth could be mounted to each respective adjoining inside face of the U-shaped retainer bracket. The ratchet "track" teeth need only be in a straight, flat track arrangement.

Further alternatively, the two toothed retainer posts (carrying the ratchet toothed track) could extend outwardly from the outside bottom wall of the housing, making the housing the male member, instead of the female member of the first embodiment. In this further alternative embodiment, the U-shaped retainer bracket would have mating openings in the back wall thereof, with a ratchet tooth extending into each one.

When utilizing toothed retainer posts, regardless of position/embodiment, a certain amount of flex could be allowed in the reinforced sidewalls of the U-shaped retainer. This flex could allow an extra "notch" or tooth engagement on the ratchet track teeth extending longitudinally along the posts. This would result in a tighter positioning of the U-shaped bracket to the housing and against the panel or door to which they are mounted.

Lastly, in the alternative, while the above-recited embodiments have a single ratchet tooth for engaging ratchet track teeth, more than one ratchet tooth can be used in series. In this instance plural ratchet teeth would provide more holding force which would permit both the ratchet teeth and the ratchet track teeth to be made of weaker materials, which usually equates to less expensive materials.

DETAILED DESCRIPTION

Figure 1:
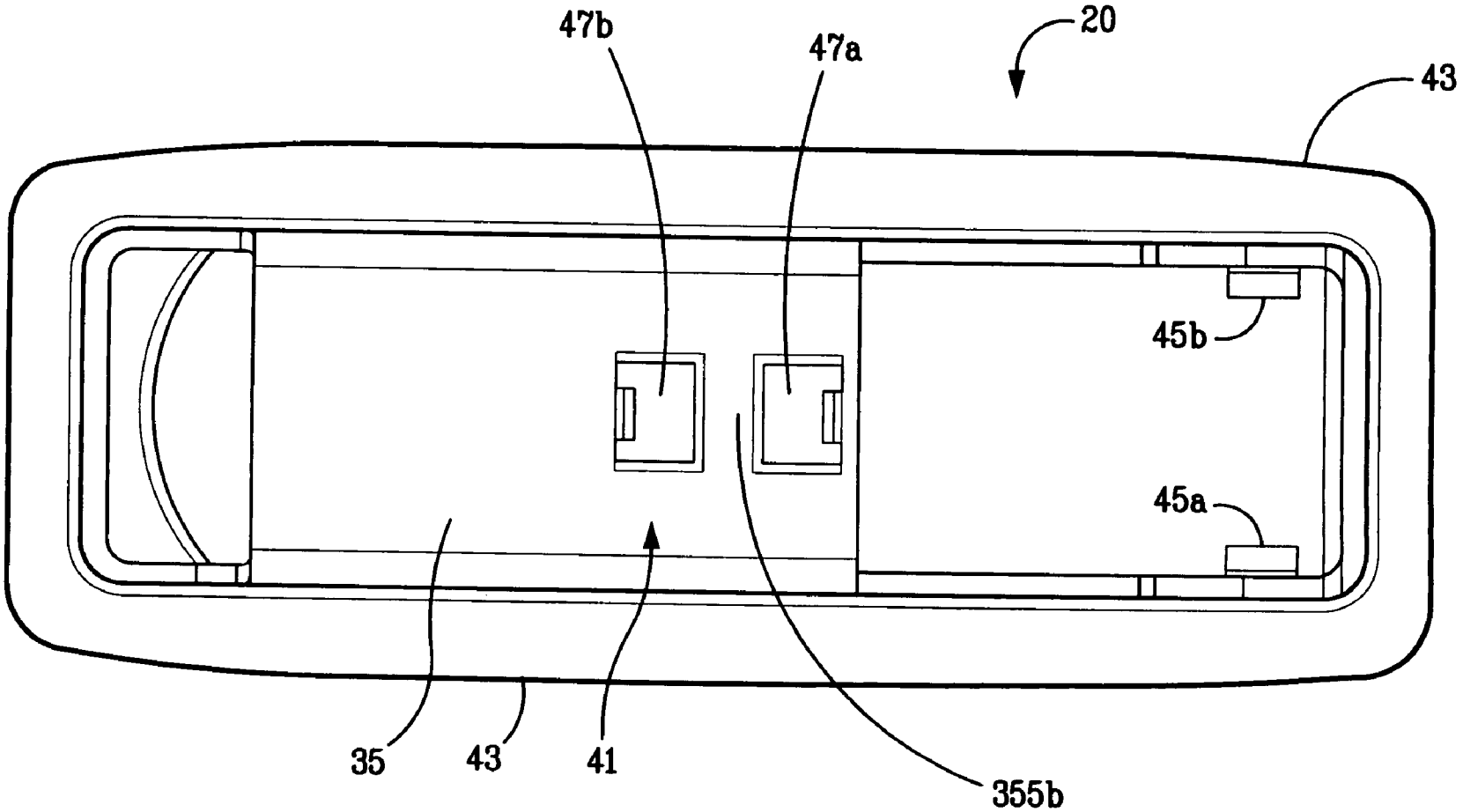
FIG. 1 is a bottom view of an example of a latch housing which forms a latch housing assembly which is the subject of the present invention.
Figure 2:
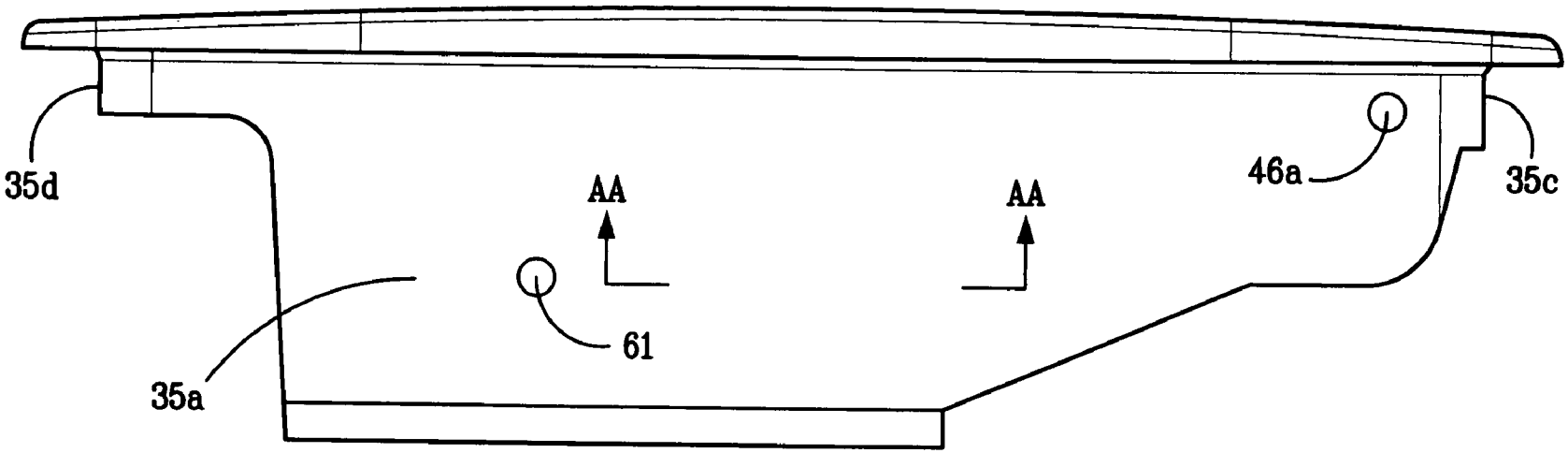
FIG. 2 is a side view of the latch housing shown in FIG. 1.
Figure 3:
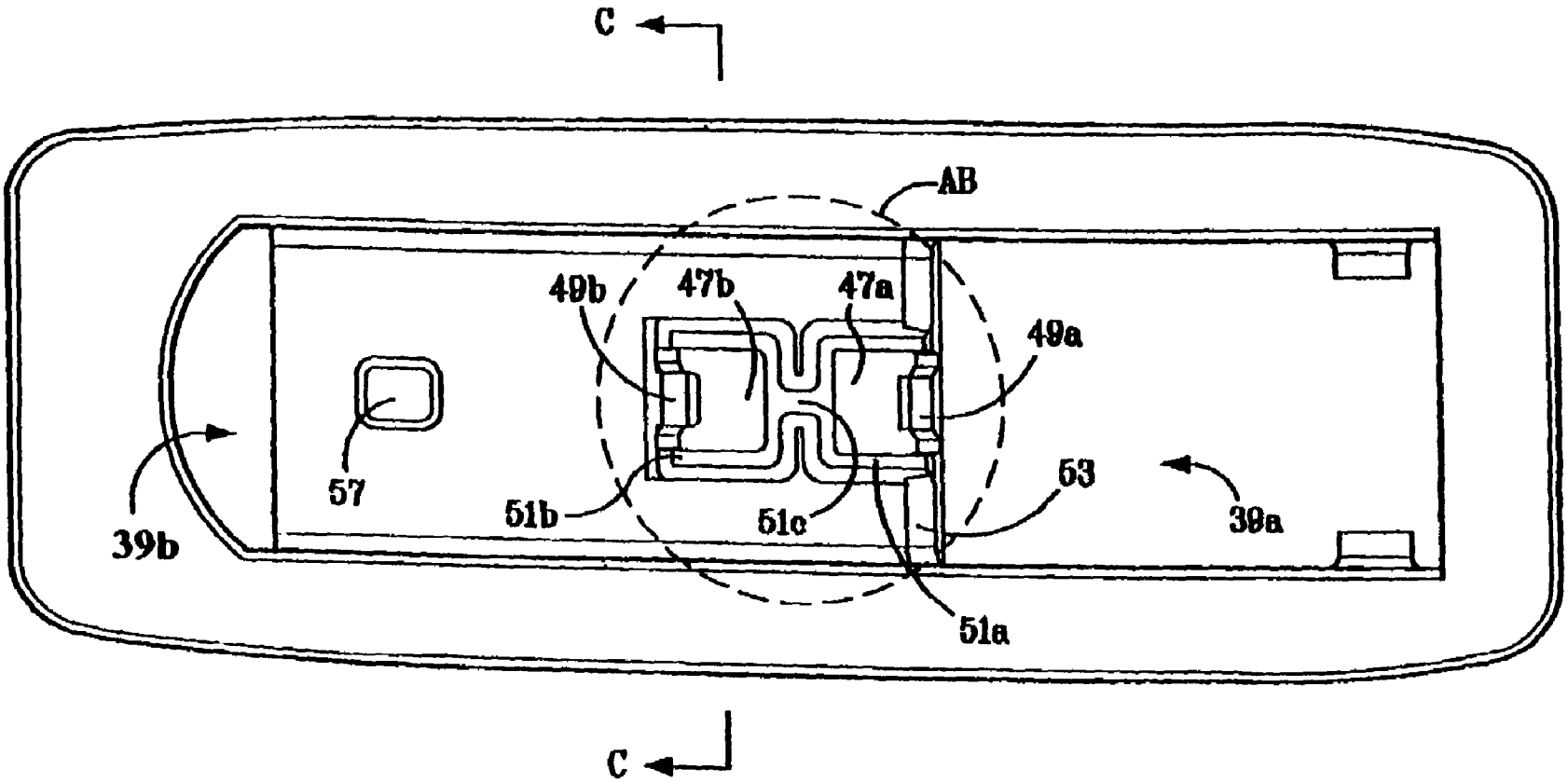
FIG. 3 is a top view of the latch housing shown in FIG. 1.
Figure 3A:
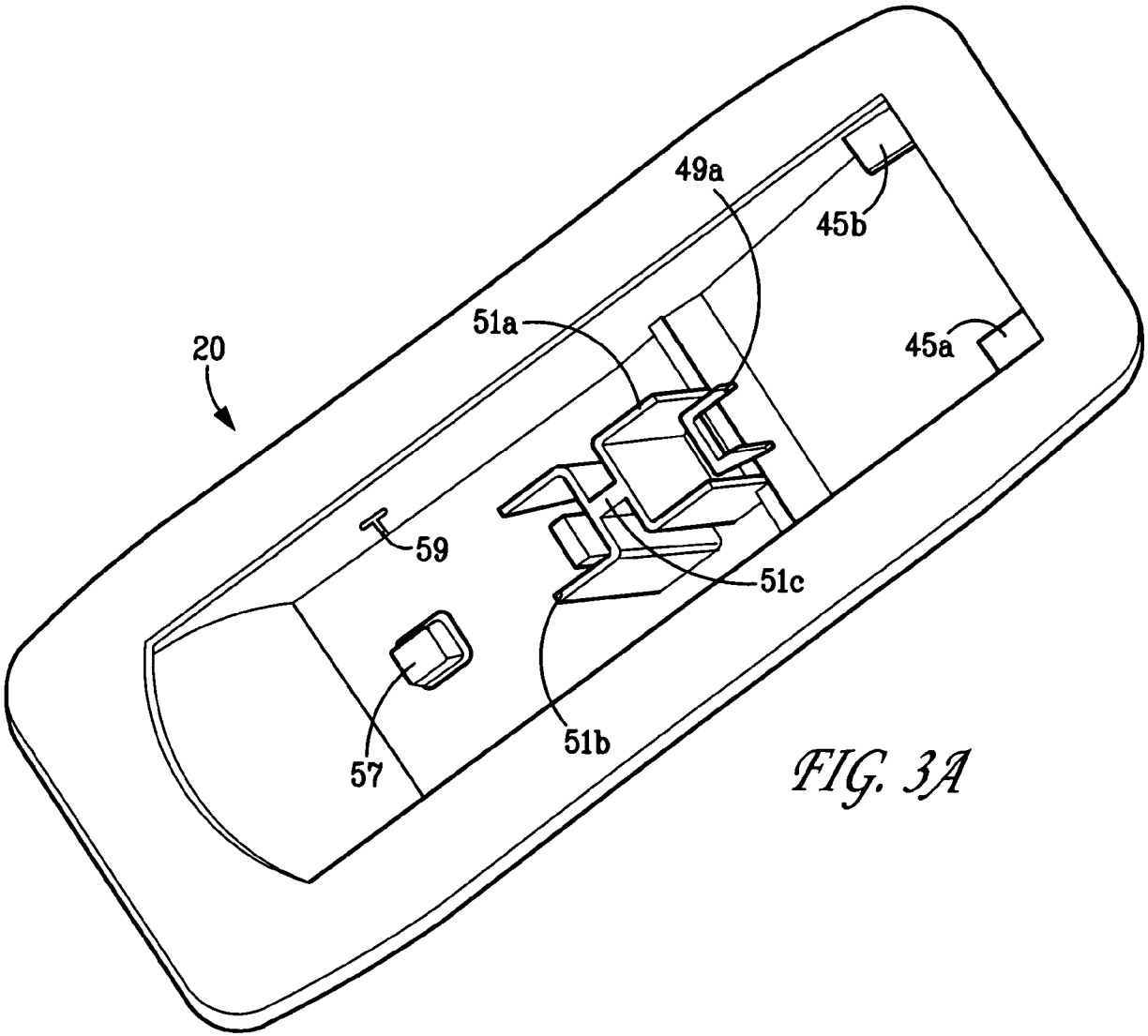
FIG. 3*a* is a top perspective view of the latch housing as shown in FIG. 3.

The latch housing assembly includes a latch housing 20 and a retainer 22. In the clamped position, the latch housing is coupled to the retainer. The latch housing is disposed in the bore of a member 23. The member could be a door such as a cabinet door or a compartment door. A portion of the member is disposed and clamped between the retainer 22 and latch housing 20.

Now referring to FIGS. 10-16, the retainer 22 has a bottom wall 24. The bottom wall has, extending therefrom, an insert 25*a*, 25*b*. The insert includes a first post 25*a* and a second post 25*b*. The posts extend upwardly away from and perpendicular to the bottom wall. Each post has a side 26*a*, 26*b*. Each side 26*a*, 26*b* faces an opposite end of the retainer. Each side 26*a*, 26*b* has a plurality of outwardly and downwardly sloping protrusions 27. The protrusions form a rack of sequentially positioned teeth 27 which interlock with a portion of the latch housing 20. Also extending upwardly from the retainer bottom, on opposite sides of the bottom wall, is sidewall 28*a*, 28*b*. A reinforcement 29 to add strength to the retainer protrudes outwardly from the sidewall and bottom wall and away from the insert. The reinforcement, integral with the sidewall and bottom wall, is formed as a plurality of external supports 29.

The retainer bottom wall has a rectangular cut-out section 31 forming a rectangular indentation 31 in the bottom wall. The indentation helps the latch housing assembly accommodate a latch assembly disposed therein.

The retainer posts 25*a*, 25*b* each have four sides which expand outwards towards where the base of each post joins the bottom wall. Otherwise, each post generally has a rectangular cross section. Each post, starting at an end opposite its base, on three of its sides, excluding the side having teeth, has protruding outwardly therefrom, longitudinally extending sections 33. These sections extend about halfway down each post to the point where each post expands outwardly.

Each tooth has a surface 277*a* which forms an angle with its respective post side surface of 140 degrees. Each tooth also has a surface 277*b* which forms an angle with its respective post side surface of 80 degrees.

Referring to FIGS. 1-9, the latch housing 20 includes a latch housing bottom wall 35. Extending upwardly from the latch housing bottom wall is a latch housing sidewall 37*a*, 37*b*, 37*c*, 37*d*. The sidewall has a first longitudinally extending section 37*a*, a second longitudinally extending section 37*b*, a first transverse section 37*c* and a second transverse section 37*d*. The first longitudinal section 37*a* is spaced apart from the second longitudinal section 37*b* and parallel thereto. The first transverse section 37*c* is spaced from the second transverse section 37*d* and parallel thereto. Each transverse section 37*c*, 37*d* forms an opposite transverse end of the sidewall. Each is integral with the longitudinal sections 37*a*, 37*b* and perpendicular thereto. The sidewall 37*a*, 37*b*, 37*c*, 37*d*, at each opposite transverse end, has openings 39*a*, 39*b* therein to accommodate the latch assembly. The sidewall longitudinal sides have a length greater than the length of the bottom wall such that each longitudinal side has a portion extending beyond the longitudinal length of the bottom wall. These portions which extend beyond the bottom wall bound the end opening 39*a* which helps to accommodate the latch assembly. The latch housing has an open end 41 opposite the bottom wall. The open end 41 is bounded by a ledge 43. The ledge extends outwardly from an end of the sidewall opposite the bottom wall. Near one of the latch housing open end 39*a* are two circular nubs 45*a*, 45*b* which protrude inwardly from the longitudinal sidewall portions. The circular nubs assist in mounting the latch assembly in the latch housing. Bores 46*a*, 46*b* can pass through the wall and through each nub.

A retainer receiving aperture 47*a*, 47*b* opens through the latch housing bottom wall. The aperture has a first opening 47*a* separated from a second opening 47*b* by a portion 355*b* of the bottom wall. The receiving aperture, at each aperture's longitudinal end, has a ratchet member 49*a*, 49*b* extending away from the bottom wall. Each ratchet, at its end, opposite the bottom wall, has an inwardly facing tooth 499*a*, 499*b*.

An internal wall 51*a*, 51*b*, 51*c* extend away from the bottom wall 35 and partially around the periphery of the aperture, partially bordering the aperture. The internal wall has a first C-shaped section 51*a* which partially boarders the first aperture opening 47*a* and a second C-shaped section 51*b* which partially borders the second aperture opening 47*b*. Adjoining each C-shaped section is an upward projecting beam section 51*c*.

A traverse internal end wall 53 extends upwardly from a first end 355*a* of the bottom wall. The traverse end wall bounds a first end of the first opening 47*a*. One of the ratchets 49*a* extends upwardly from the transverse end wall 53. The end wall has notched sections 55.

The bottom wall can further have extending upwards therefrom a platform 57 to facilitate pivoting of a push-button 100*a* of the latch assembly 100*a*, 100*b*. Further, the bottom wall can have supported above it an eyelet 59 to receive a portion of the latch assembly through a bore 61 aligned with eyelet 59. The bore 61 can pass through each sidewall section 51*a*, 51*b*.

Figure 4:
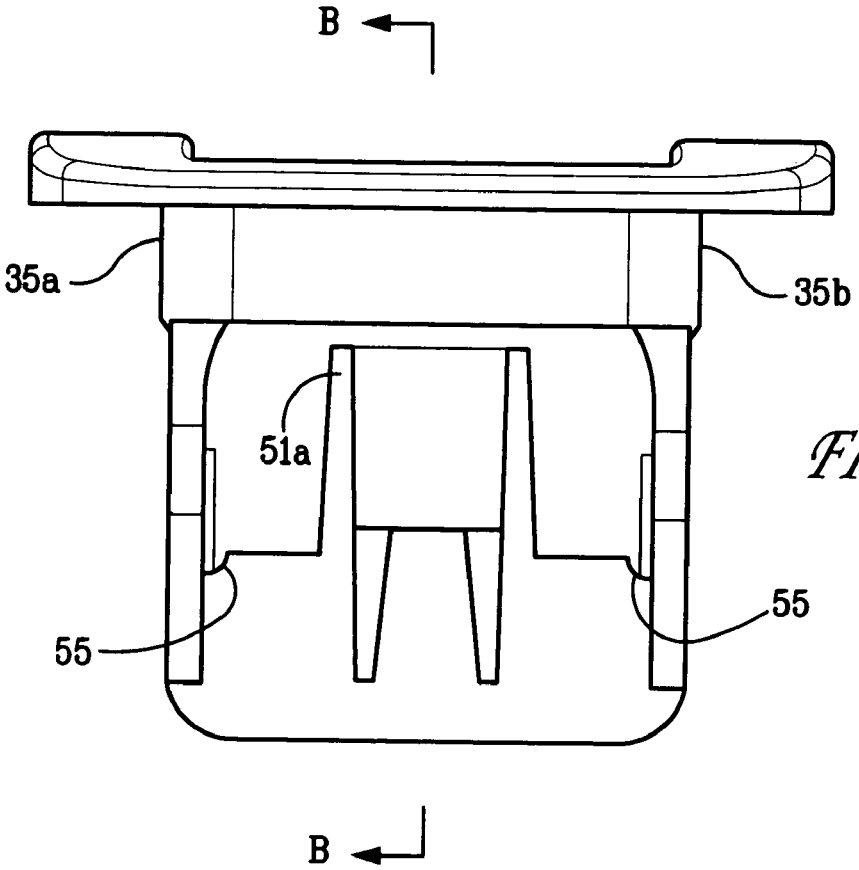
FIG. 4 is an end view of the latch housing shown in FIG. 1.
Figure 5:
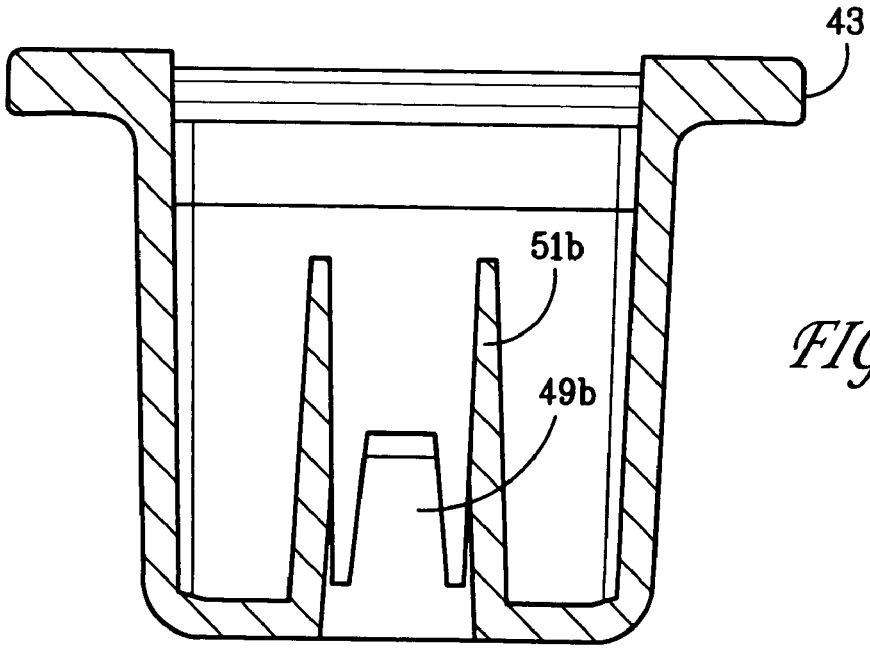
FIG. 5 is a sectional view of the latch housing taken along the sectional view lines C-C shown in FIG. 3.
Figure 6:
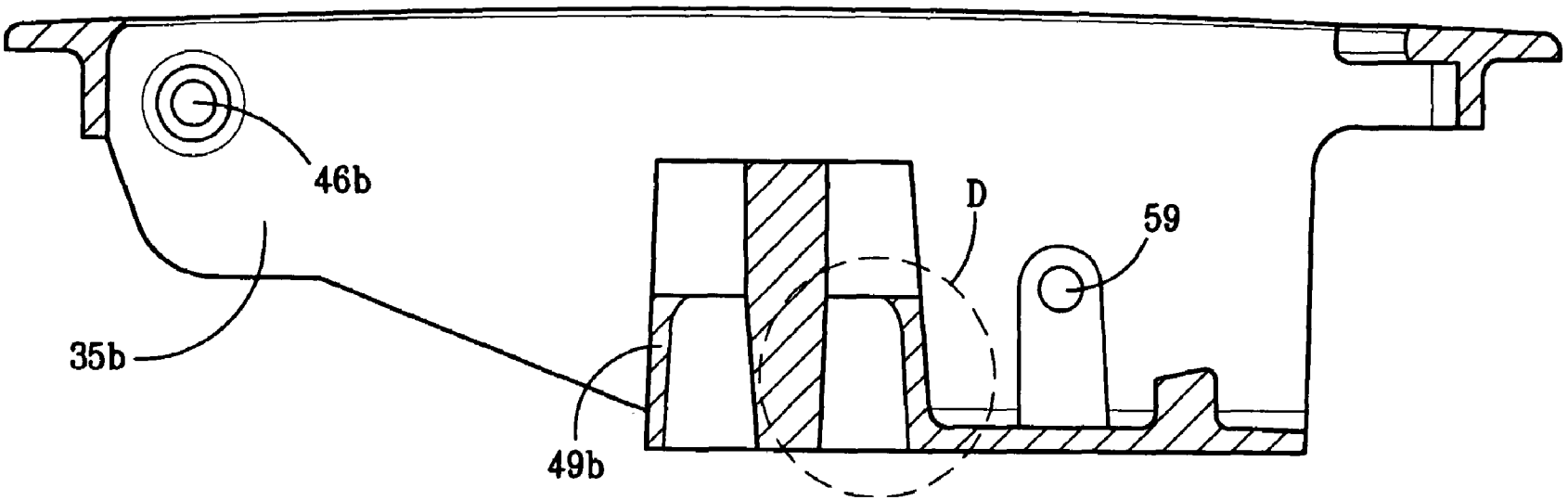
FIG. 6 is a side sectional view of the latch housing taken along the sectional view lines B-B shown in FIG. 4.
Figure 7:
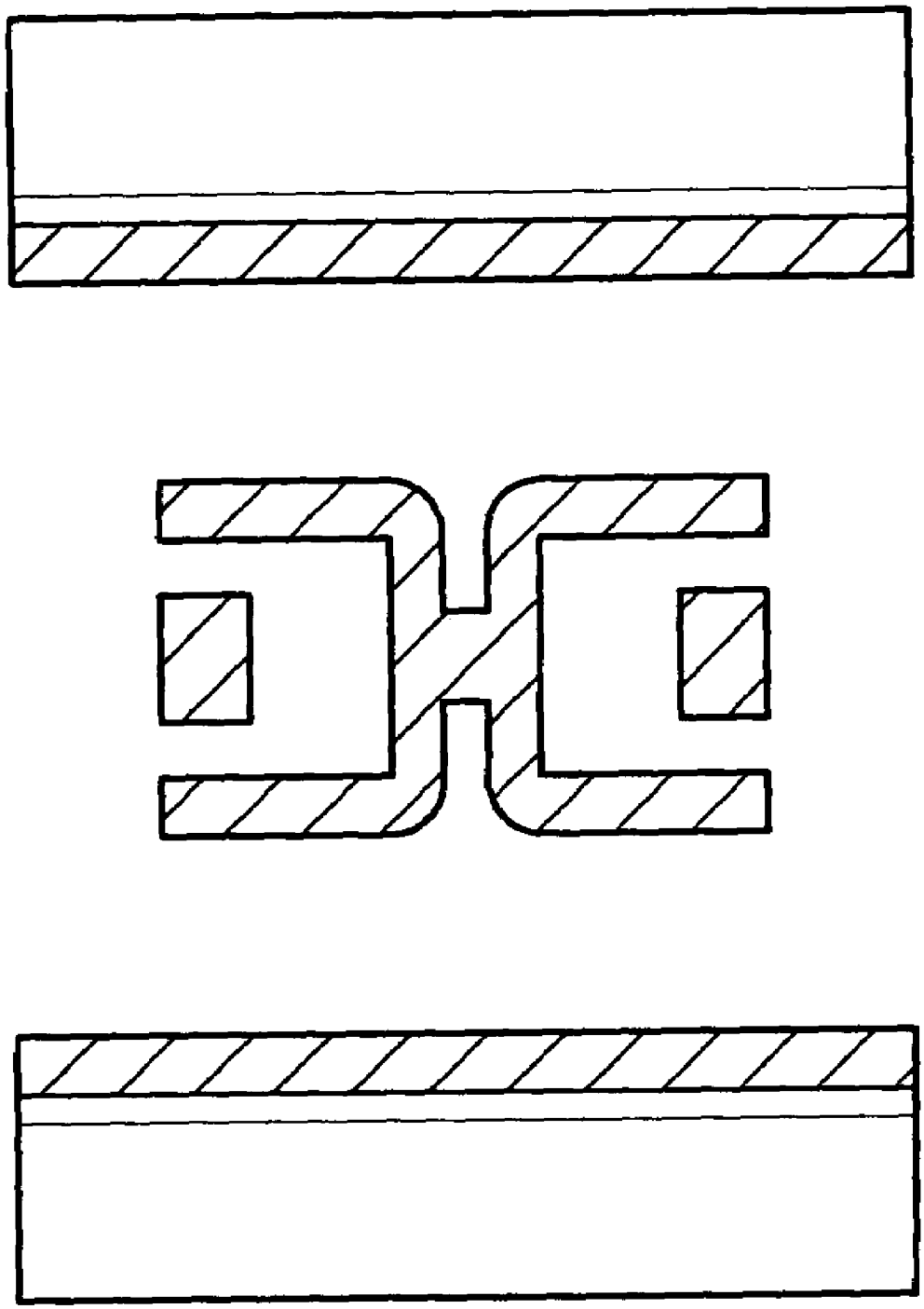
FIG. 7 is a bottom sectional view of the latch housing taken along the sectional view lines M-M shown in FIG. 2.
Figure 8:
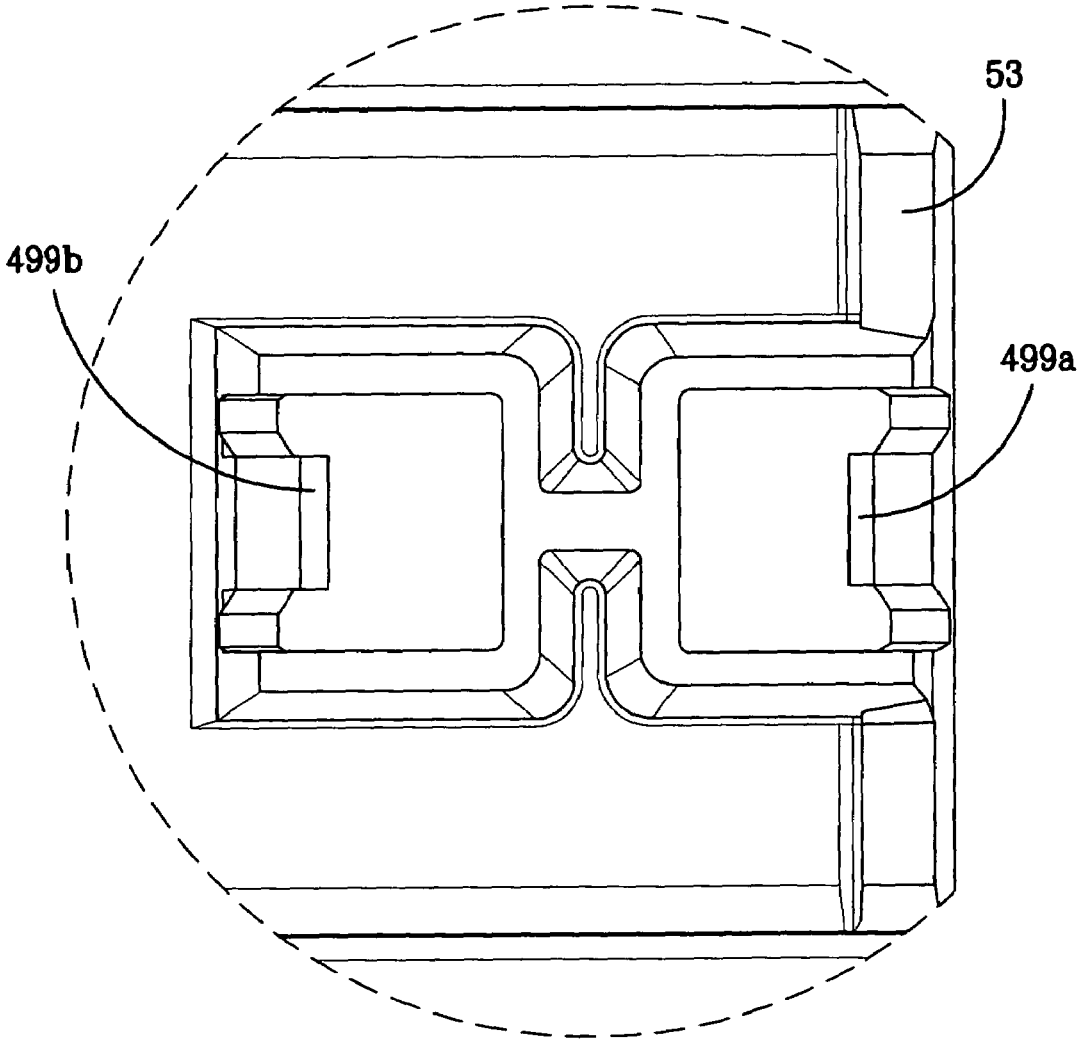
FIG. 8 is a blown-up view of the detail AB shown in FIG. 3.
Figure 9:
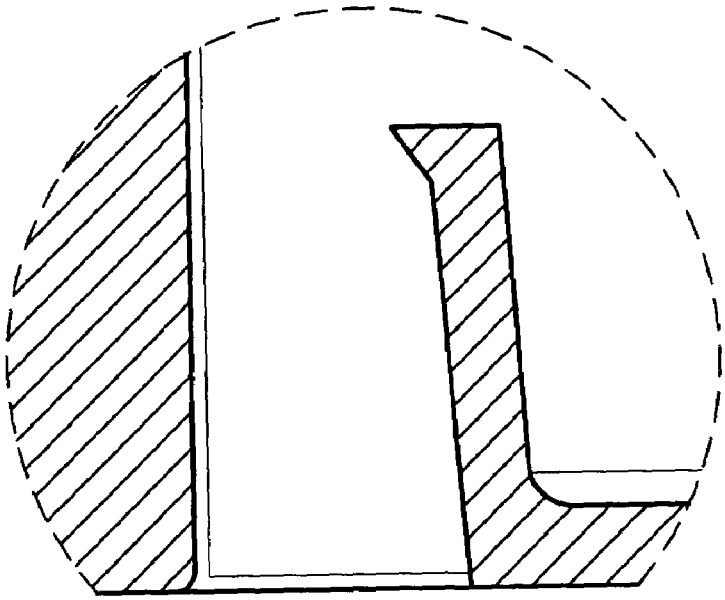
FIG. 9 is a blown-up view of the detail D shown in FIG. 6.
Figure 10:
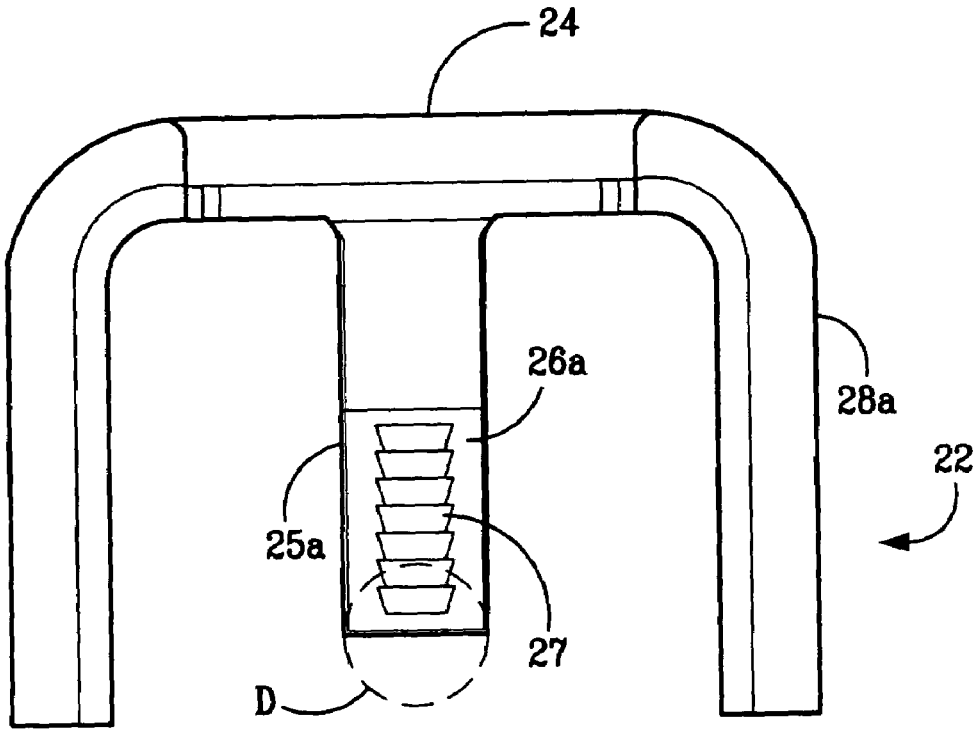
FIG. 10 is a side view of a retainer which forms a part of the latch housing assembly which is the subject of the present invention.
Figure 11:
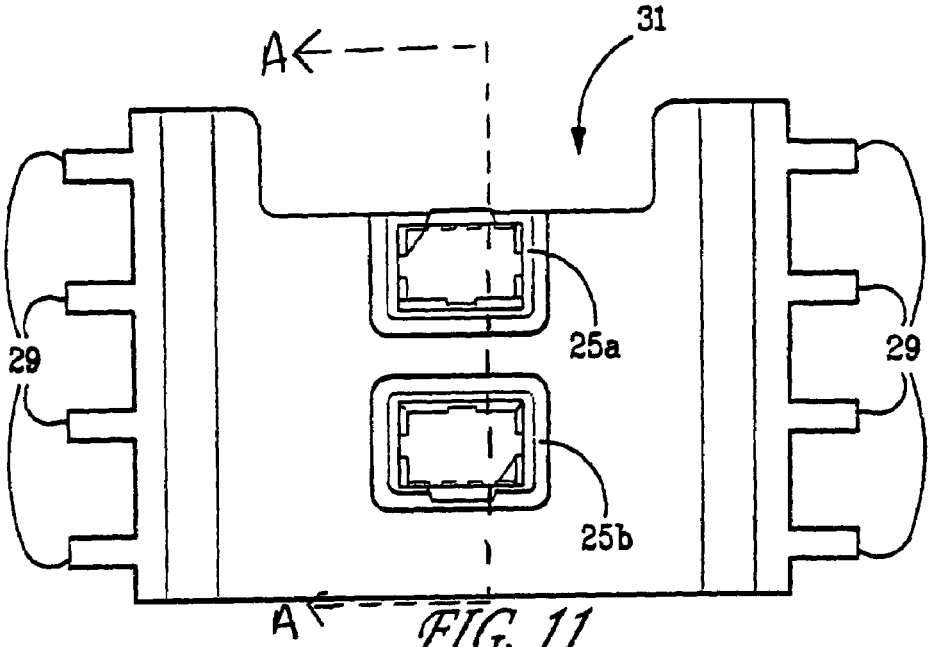
FIG. 11 is a top view of the retainer disclosed in FIG. 10.
Figure 11A:
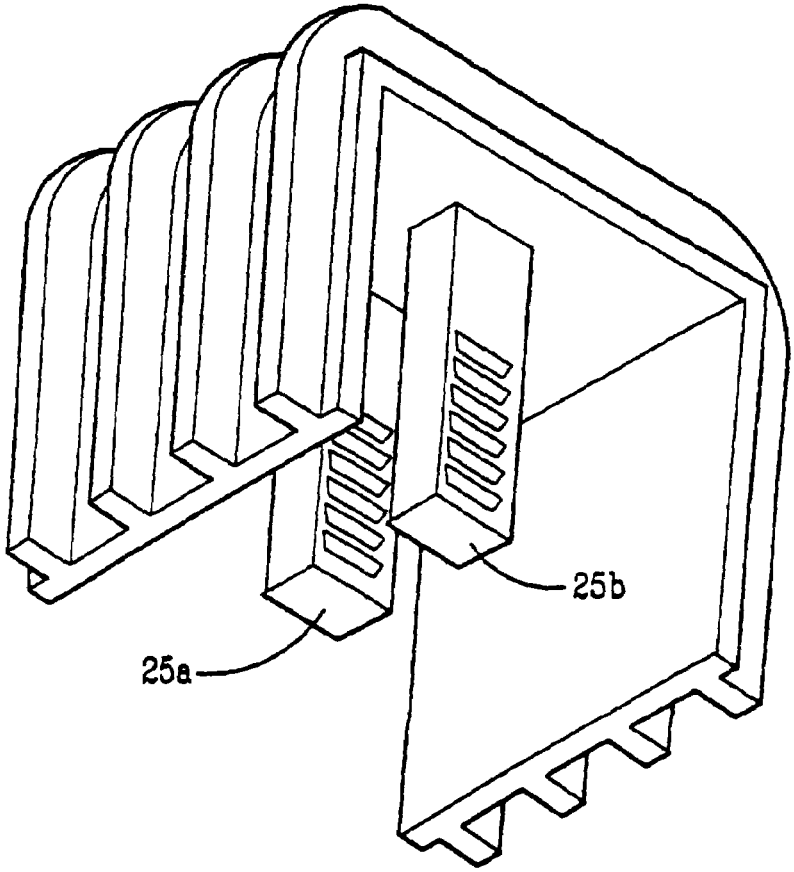
FIG. 11*a* is a top perspective view of the retainer shown in FIG. 11.
Figure 12:
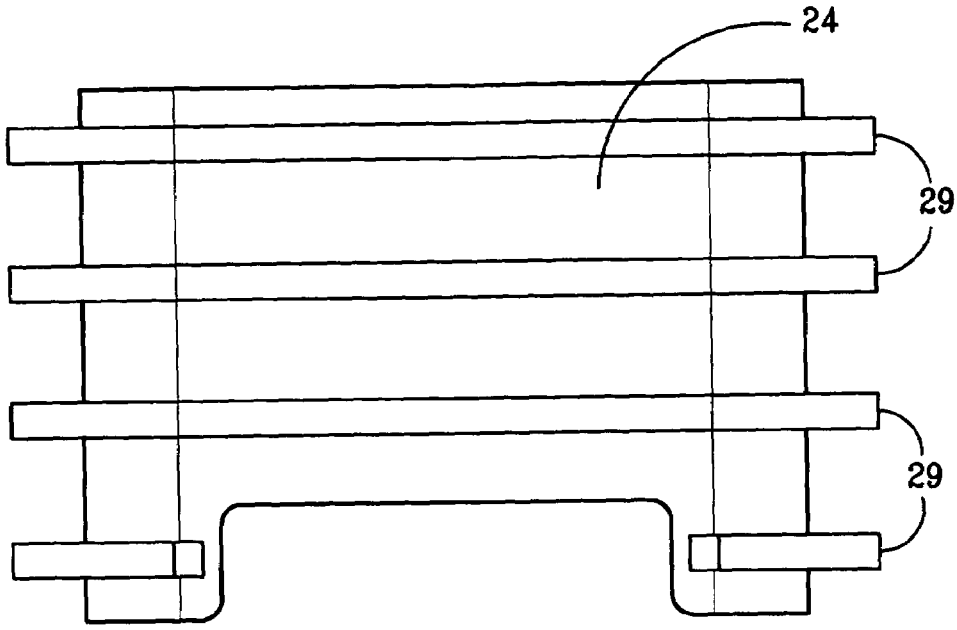
FIG. 12 is a bottom view of the retainer disclosed in FIG. 10.
Figure 13:
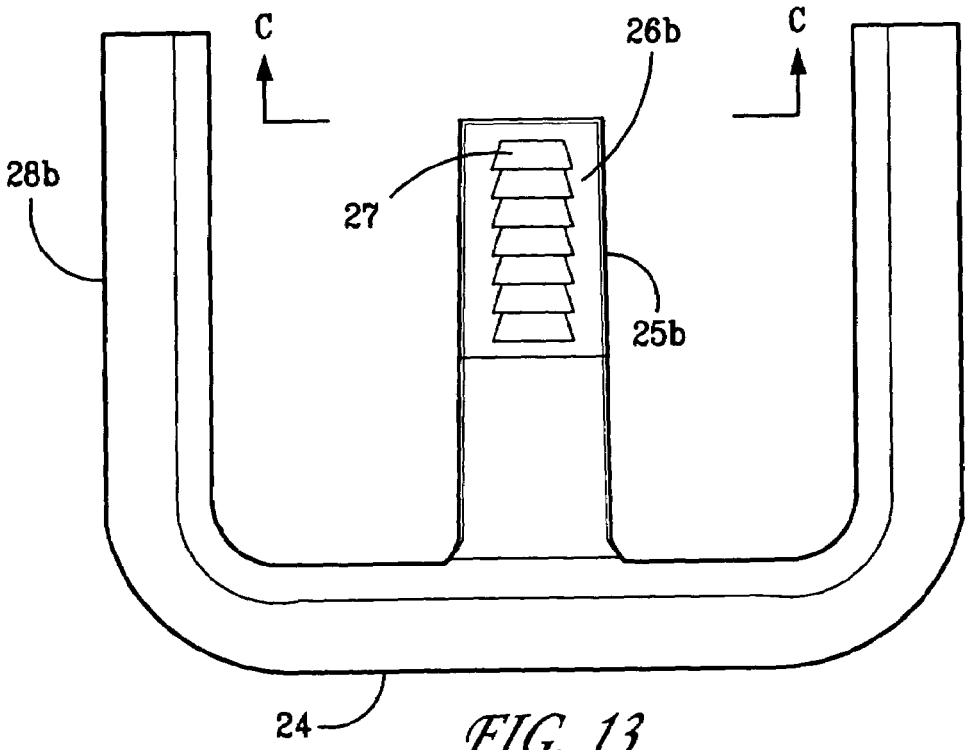
FIG. 13 is an end view of the retainer shown in FIG. 12; the end view is opposite the end view shown in FIG. 10.
Figure 14:
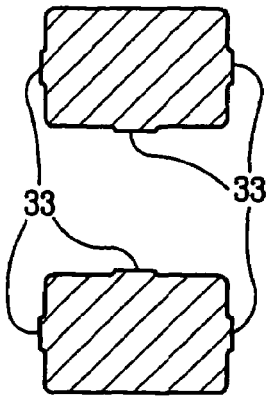
FIG. 14 is a sectional view of the retainer taken along view line C-C shown in FIG. 10.
Figure 15:
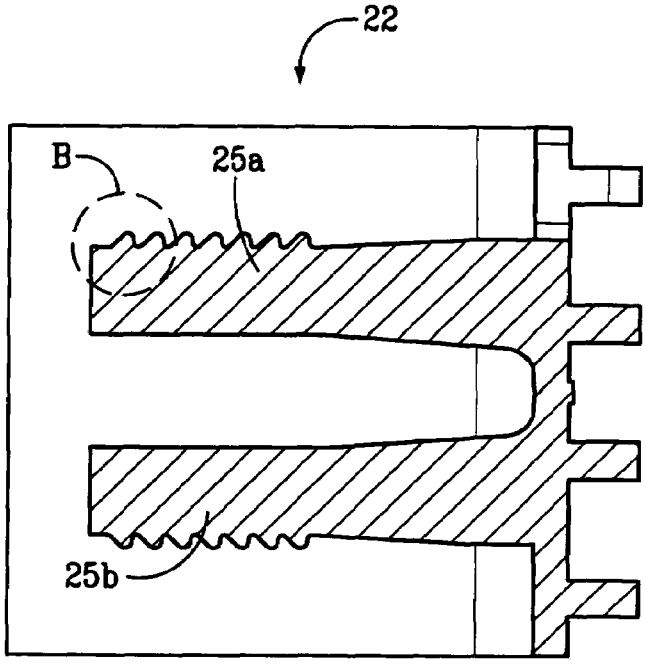
FIG. 15 is a sectional view of the retainer taken along view line A-A shown in FIG. 11.
Figure 16:
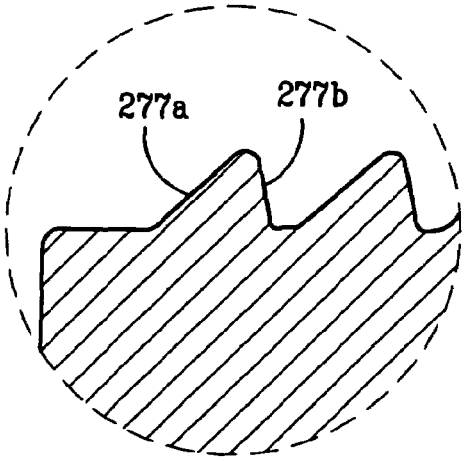
FIG. 16 is a blown-up view of detail B shown in FIG. 15's sectional view of the retainer.
Figure 17:
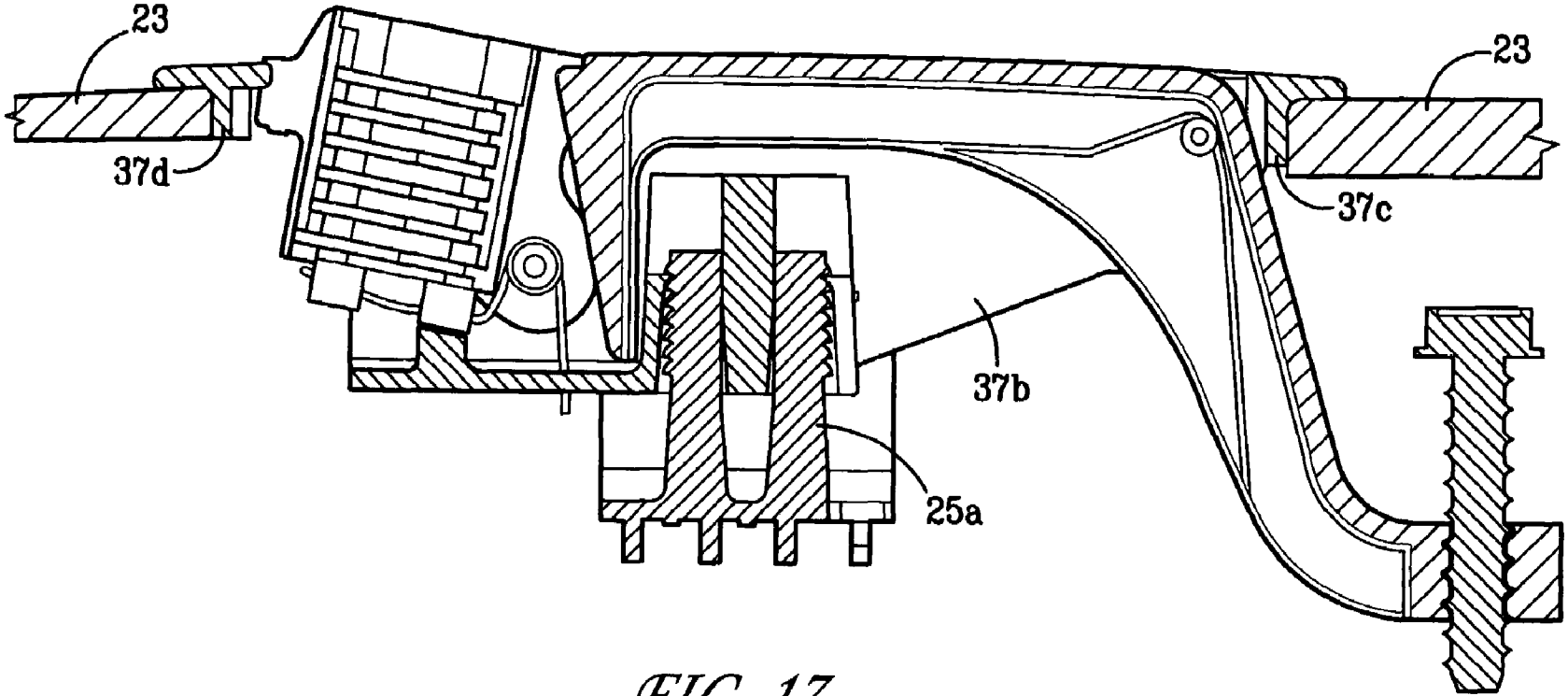
FIG. 17 is an example of a cut away side view of a latch housing assembly of the present invention having a latch assembly disposed therein.
Figure 18:
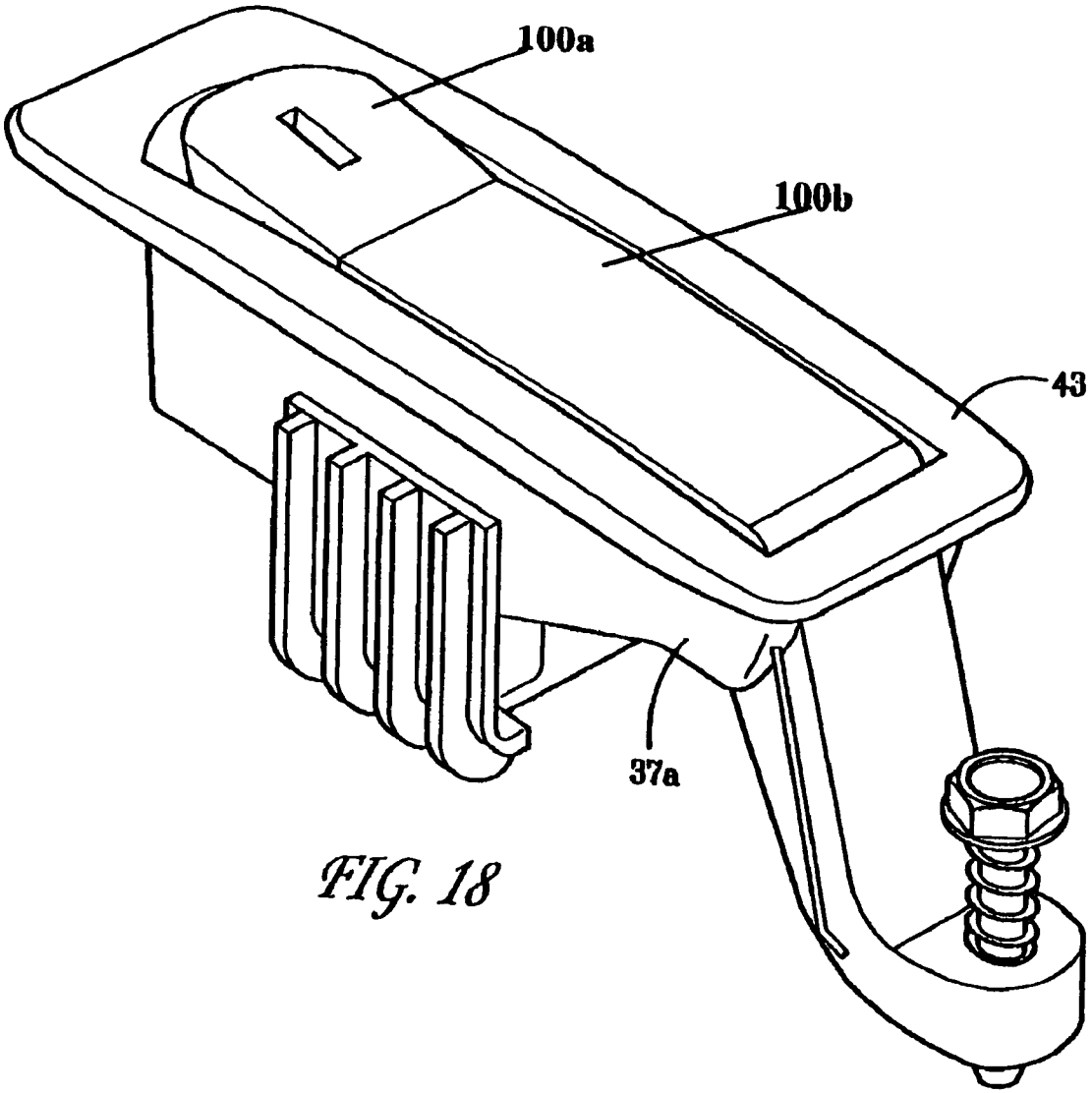
FIG. 18 is a top side perspective view of an example of a latch housing assembly of the present invention having a latch assembly disposed therein.

It can be seen from FIG. 4, that the internal walls 51*a* and 51*b*, which extend from the bottom wall of the housing, are tapered slightly on both sides. This facilitates clearances for assembly and the interaction of the rack teeth 27 of the two upstanding toothed ratchet posts 25*a*, 25*b* which are each canted outwardly about 1° or slightly more, FIG. 15. Therefore, as the retainer 22 is pushed onto the housing 20, the toothed ratchet posts will exert a slight sideways force against the respective inward facing ratchet tooth member 49*a*, 49*b* and keep a positive contact therewith.

It is important to note that the present invention has been described with reference to an example of an embodiment of the invention. It would be apparent to those skilled in the art that a person understanding this invention may conceive of changes or other embodiments or variations which utilize the invention as set forth in the appended claims. The specifications and drawings are therefore to be regarded in an illustrative rather than in a restrictive sense. Accordingly, many changes can be made in the above-described invention without departing from the intent and scope thereof. Substitutions and changes can be made while still being within the scope and intent of the invention and of the appended claims. Accordingly, it is not intended that the invention be limited except as may be necessary in view of the appended claims.

What is claimed is:

1. A latch housing mounting assembly, comprising:

a housing member having a plurality of walls;

a retainer member having walls for contacting an object to which the housing is to be mounted, said retainer member walls extending beyond to be outboard of the walls of the housing, wherein said retainer member is oriented to receive said housing member;

wherein one of either said housing member or said retainer member being a first member having at least one aperture on a wall facing the other member being a second member;

wherein the said second member has at least one rack of sequentially positioned one-way ratchet track teeth mounted on at least one projecting post outstanding from a wall facing said first member; and wherein the said first member has an internal wall bordering partially about the periphery of said aperture and a ratchet member having a ratchet tooth positioned to engage a respective rack of one-way ratchet track teeth;

wherein when said second member is pushed together with said first member each said projecting post of said second member carrying a respective rack of said sequentially positioned one-way ratchet track teeth extends through a respective aperture of said first member to engage a respective ratchet tooth to hold said members together.

2. The assembly of claim 1, wherein said first member has a plurality of apertures in said wall facing the said second member and wherein said second member has a plurality of outstanding posts extending from said wall facing said first member; said first member also including a respective internal wall bordering each respective aperture, each said respective internal wall being C-shaped to partially extend about the periphery of a respective aperture, each first member also including a respective ratchet member having a ratchet tooth positioned for each respective aperture and facing said respective C-shaped internal wall, each said respective post carrying a respective said rack of one-way ratchet track teeth; wherein when said first and second members are pushed together each outstanding post and its rack of one-way ratchet track teeth extend through a respective aperture to engage a respective ratchet member's ratchet tooth.

3. The assembly of claim 2, wherein said second member is said retainer member which is U-shaped, and wherein said plurality outstanding posts is a pair of upstanding posts extending into the U-shaped area from a back wall of said U-shaped retainer member.

4. The assembly of claim 3, wherein said first member is said housing member which includes a bottom wall and wherein said plurality of apertures is a pair of apertures in said bottom wall.

5. The assembly of claim 4, wherein each of said housing member respective C-shaped walls are tapered, and wherein each said ratchet member having a ratchet tooth includes an outstanding canted ratchet post carrying said ratchet tooth.

6. The assembly of claim 5, wherein said housing member is rectangular and includes sidewalls and end walls, and wherein said housing member is intended to fit into an opening in the object to which the housing member is to be mounted.

7. The assembly of claim 6, wherein the housing member has an open top face and a peripheral flange extending outwardly about the sidewalls thereof, the peripheral flange intending to seat against an outside face of the object to which the housing member is to be mounted.

8. A latch housing mounting assembly, comprising: a housing member having sidewalls, end wall, a bottom wall, and an open face with a peripheral flange extending outwardly about the sidewalls and end walls thereof, said housing being intended to fit into an opening in an object to which said housing is to be mounted, with said peripheral flange seated against an outside face of said object; a U-shaped member having a pair of upstanding posts extending into the U-shaped area from a back wall of said U-shaped retainer member with each post carrying a rack of one-way ratchet track teeth; wherein said housing member bottom wall includes a pair of apertures for receiving a respective one each of said retainer member upstanding posts and receiving the track teeth carried thereon; wherein each said housing receiving aperture has a ratchet member attached to the housing bottom wall and carrying a ratchet tooth associated therewith, wherein each said housing ratchet member ratchet tooth is inward facing; wherein the U-shaped retainer member has sidewalls which extend outboard of the sidewalls of the housing member; and wherein when said retainer member is pushed together with said housing member each housing ratchet member ratchet tooth engages a respective rack of one-way ratchet track teeth of said retainer member.

9. The assembly of claim 8, wherein the housing member sidewalls are sized to fit said object opening, and wherein said U-shaped retain member sidewalls are positioned to engage an inside face of the object when said retainer member engages said housing member.

10. The assembly of claim 9, wherein said retainer member pair of upstanding posts are rectangular in cross-section, and wherein each said respective ratchet track teeth extend longitudinally along a respective upstanding post.

11. The assembly of claim 10, wherein said ratchet track teeth face in opposite directions, and wherein said each ratchet tooth inward facing tooth faces the other inward facing tooth.

12. The assembly of claim 11, wherein said retainer member U-shaped sidewalls include reinforcing ribs.

13. The assembly of claim 12, wherein said housing member includes an internal upstanding wall surrounding each respective receiving aperture.

14. The assembly of claim 13, wherein said housing member internal upstanding wall about a respective receiving aperture is C-shaped, and wherein the back ribs of said C-shaped walls are connected with a beam section wall.

15. The assembly of claim 14, wherein said housing member also includes a transverse internal end wall which extends up from the bottom wall of the housing member and bounds a first end of one of said receiving apertures.

16. The assembly of claim 15, wherein the respective ratchet tooth associated with the receiving aperture bounded by the transverse internal end wall extends from said wall.

17. The assembly of claim 16, wherein said transverse internal end wall includes a pair of notched sections.

18. The assembly of claim 17, wherein said housing member also includes a pair of eyelets mounted to facing sidewalls thereof, and a bore passing though facing sidewall sections.

* * * * *